United States Patent [19]

Hittel

[11] 4,267,709

[45] May 19, 1981

[54] TWIN-BEDDED WARP KNITTING MACHINE

[75] Inventor: Gerhard Hittel, Rodgau, Fed. Rep. of Germany

[73] Assignee: Karl Mayer Textilmaschinenfabrik GmbH, Obertshausen, Fed. Rep. of Germany

[21] Appl. No.: 97,032

[22] Filed: Nov. 23, 1979

[30] Foreign Application Priority Data

Dec. 1, 1978 [DE] Fed. Rep. of Germany ..... 2851995

[51] Int. Cl.[3] ..... D04B 23/02

[52] U.S. Cl. ..... 66/87

[58] Field of Search ..... 66/87, 88

[56] References Cited

U.S. PATENT DOCUMENTS

| | | | |
|---|---|---|---|
| 3,646,782 | 3/1972 | Kohl | 66/87 |
| 3,665,733 | 5/1972 | Jackson | 66/87 |
| 3,842,625 | 10/1974 | Apren et al. | 66/87 |

*Primary Examiner*—Ronald Feldbaum

*Attorney, Agent, or Firm*—Omri M. Behr; Martin Sacks

[57] ABSTRACT

A twin needle bed warp knitting machine having a plurality of commonly swingable guidebars of which at least one thereof forms stitches on both needle beds and wherein at least one guidebar performs one underlapping displacement includes means of adjusting the spacing between the needle beds in the knock-over position to less than the width of the flat end portion of the needle guide with the distance therebetween increasing when the needle beds are moved to the lapping position.

4 Claims, 9 Drawing Figures

TWIN-BEDDED WARP KNITTING MACHINE

BACKGROUND OF THE INVENTION

1. Field of the Invention

The present invention relates to twin-bedded warp knitting machines, and in particular, to a twin bedded machine which permits the needle beds to be spaced closer together in the knock-over position than the width of the flattened end portion of a guide which performs an underlapping operation.

2. Description of the Relevant Art

Conventional twin-bedded warp knitting machines include a plurality of commonly swingable guidebars wherein at least one guidebar forms stitches across both needle beds and generally, at least two guidebars, singly or together, perform an underlap displacement. The guides generally have a flat end portion which runs parallel to the swinging plane of the guide and the needle beds, being parallel to each other, are provided with a separation which is slightly larger than the width of the end portions of the guides.

A typical warp knitting machine of this type is disclosed in German Patent No. 1,208,030. The latch needles disclosed therein on both needle beds are disposed in a position essentially parallel to each other. The guidebars are driven by means of a three stroke eccentric cam so that for each cycle of the needles three cycles of the guidebar swinging movement are provided. In machines of this type, it does not matter if the distance between both the needle beds is large or small, since the underlapping displacement of the guides always occurs when the needles of a needle bed are in the knock-over (lowest) position.

In another known twin-bedded warp knitting machine such as that disclosed in Germany Offenlegungsschrift No. 2,134,279 the guidebar driving mechanism is so arranged that a single forward and backward swinging movement of the guidebars corresponds to a single working cycle of the needle beds. These single stroke machines have a decided advantage over the three-stroke machines since it is possible to operate them at much higher working speeds. However, they are unable to manufacture short pile ware, since the substantially parallel orientation of the needle beds must provide a substantial distance therebetween in order that the corresponding guides can move between them to perform the required underlapped displacement. It is therefore a requirement that the minimum separation between the needles must be equal to or slightly greater than the width of the bottom portion of the guides plus a little extra to allow for a certain amount of play in the movement of the guides and needle bed in order that the guides may be freely displaced during the displacement movements of the guides. When two or more simultaneous guides must be displaced at the same time, additional distance must be allowed between the needle beds in order to provide collision free displacement motion therebetween. By rotating the guides used for the underlap displacement by ninety degrees it is possible to reduce the distance required between the needle beds during the underlap displacement movement which is measured perpendicular to the needle bed. However, this requires that each needle bed leaves sufficient space for movement of this guide in the swing direction so that only every third needle space may be occupied with a needle. Therefore, the overall result is a comparatively course goods which will still have a relatively long pile.

Another twin-bedded warp knitting machine is disclosed in U.S. Pat. No. 3,221,520 issued to Bassist on Dec. 7, 1965. Provision is made therein to adjust the separation between the needle beds. Each of the three guides are separately driven and the centrally disposed guidebar alone performs an underlap displacement and swings between both needle bars. In this embodiment the needles are attached to the levers with a relatively large leverage so that the movement of the needles is substantially straight and parallel to each other.

SUMMARY OF THE INVENTION

Thus is an object of the present invention to provide a twin-bedded warp knitting machine which is capable of operating with a minimum of space between the needle bedS.

Another object of the present invention is to provide a twin-bedded warp knitting machine in which the drive of the guidebars is so arranged that a single forward and backward swinging movement thereof corresponds to a single working cycle of the needle beds and the distance between the needle beds is adjustable.

A further object of the present invention is to provide a twin-bedded warp knitting machine which permits the knitting beds to be disposed closer together than heretofore known.

It is yet another object of the present invention to provide a twin bedded warp knitting machine which permits the adjustment of the spacing between the needle beds to an amount which is less than heretofore known in the knock-over position and permits the needles to diverge when they are in the lapping position so that guides may freely pass therebetween in an underlap displacement movement.

Another object of the present invention is to overcome all of the shortcomings found in the prior art.

A twin-bedded warp knitting machine, according to the principles of the present invention, comprises a pair of needle bars disposed parallel to each other having a plurality of needles affixed thereon forming a pair of needle beds, the needles traversing a path from the knock-over to the lapping position in a manner which increases their separation in a direction perpendicular to the needle beds. Also included are a plurality of commonly swingable guidebars having a plurality of guides affixed thereon, the guides have flat end portions disposed parallel to the swinging plane of the guides. At least one of the guidebars form stitches on both needle beds and at least one of the guidebars perform an underlap displacement movement. The guidebars have a forward and reverse swinging movement corresponding to a single work cycle of the needle bed. Additionally included are means for adjusting the separation between the needles on one of the pair of needle bars from the needles on the other of the needle bars when the needles are in the knock-over position. The separation may be smaller than the space required for an underlap displacement by one of the guides. A pair of parallely disposed trick plates have knock-over edges disposed between the pair of needle bars, with each trick plate cooperating with one of the needle bars in the formation of stitches.

The foregoing and other objects and advantages will appear from the description to follow. In the description, reference is made to the accompanying drawing which forms a part hereof, and which is shown by way of illustration a specific embodiment in which the invention may be practiced. This embodiment will be described in sufficient detail to enable those skilled in the art to practice the invention, and it is to be understood that other embodiments may be utilized and that structural changes may be made without departing from the scope of the invention. The following detailed description is therefore not to be taken in a limiting sense and the scope of the present invention is best defined by the appended claims.

BRIEF DESCRIPTION OF THE DRAWINGS

In order that the invention may be more fully understood, it will now be described, by way of example, with reference to the accompanying drawing in which.

DESCRIPTION OF THE PREFERRED EMBODIMENT

Figure 1:
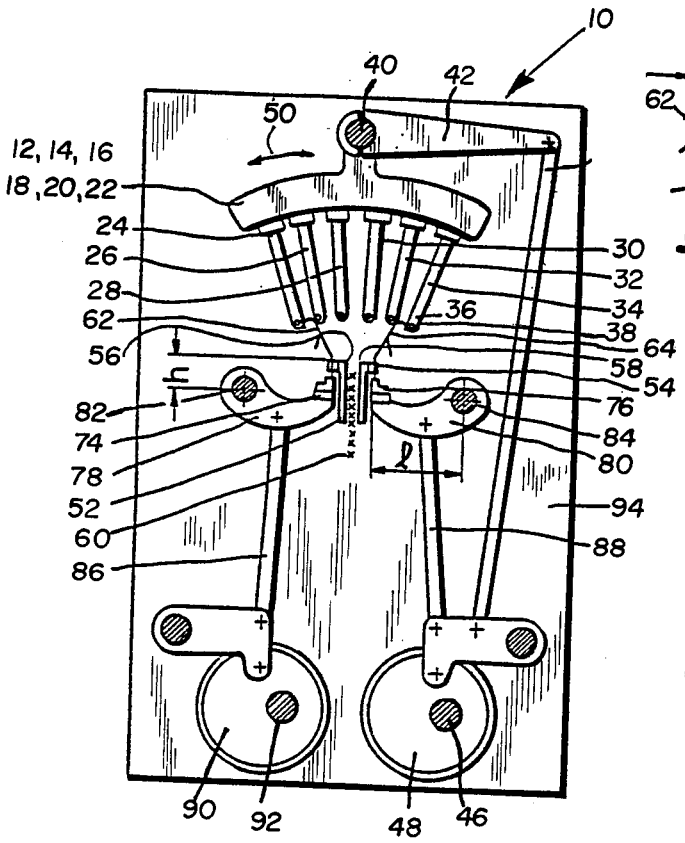
FIG. 1 is a schematic in cross-section of the important portion of a double-bedded warp knitting machine, according to the principles of the present invention.

Referring now to the figures, and in particular to FIG. 1, the relevant portion of a warp knitting machine 10 is shown having six guidebars 12, 14, 16, 18, 20, and 22, each having a plurality of guides affixed thereon, in a conventional manner, represented by guides 24, 26, 28, 30, 32 and 34. Each of the guides are provided with a flat end portion 36 provided with an eyelet 38 through which the thread is fed, in a conventional manner. The guidebars 12, 14, 16, 18, 20 and 22 can be displaced, in a conventional manner, in the swing direction by means of a pattern chain or the like. The guidebars are rotatable about a fixed axis or pivot point 40 by means of a lever 42 and rod 44 which is articulated to one end of lever 42. The other end of rod 44 is driven from the main machine shaft 46 by an eccentric cam or the like 48 so that the guides are simultaneously swung backwards and forwards in the swing direction as shown by arrow 50.

Two essentially parallel trick plates 52 and 54 are provided having knock-over edges 56 and 58, respectively, over which the as yet symmetrically driven goods or ware 60 which are still to be cut apart are pulled off. The trick plate 52 cooperates with a first row of needles 62 while trick plate 54 cooperates with a second row of needles 64 to form the stitches.

Figure 9:
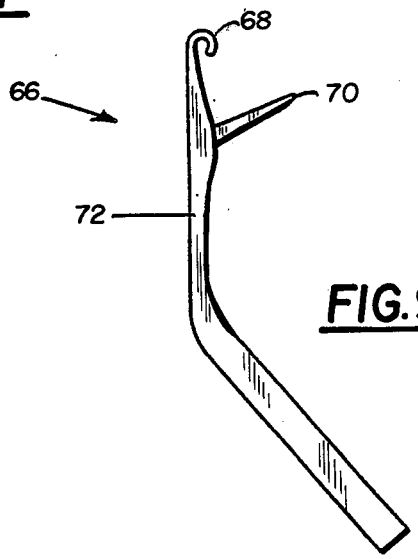
FIG. 9 discloses a latch needle having an angular shaft which may be utilized in a twin-bedded warp knitting machine, according to the principles of the present invention.

These needles are shown herein in greater detail in FIG. 9 which is an enlarged view of one needle 66. The needle 66 is provided with a conventional hook shaped portion 68, a latch portion 70 and a curved shaft portion 72, the function of which will become clear as the functioning of the preferred embodiment is described. Although the preferred embodiment discloses latch type of needle it is also possible to utilize almost any type of compound needles such as slider needles, bearded needles or the like.

Each needle bar 74 and 76 is positioned at the distal end of levers 78 and 80, respectively, which is journaled about pivot points 82 and 84, respectively. Levers 78 and 80 are driven by means of rods 86 and 88, respectively, coupled thereto. The other end of rod 86 is driven by a cam 90 affixed on shaft 92 which is driven with the same rate of speed as the main shaft 46. Rod 88 is driven by an eccentric cam, not shown, disposed on main shaft 46 and appearing therebehind in FIG. 1. All of the above elements are mounted to the frame 94 of the warp knitting machine 10 in a conventional manner.

Figure 2:
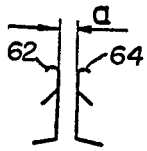
FIG. 2 shows the position of the needles when both needles beds are in the knock-over position.

Referring now to FIG. 2 which shows the position of the needles 62 and 64 in the knock-over position of the warp knitting machine. The distance "a" is adjusted by means of the device shown in FIG. 8 which will be described hereinafter, and may be less than the width "c" of the flat end portion of the guide 36 (see FIG. 5-III). The space "a" does not permit sufficient room for an underlapping displacement to occur by a guide 36. The distance a is adjusted to correspond to desired length of pile which will occur on the finished ware 60. Thus, a ware having a much shorter pile can be produced if the needles 62 and 64 can be brought closer together.

Figure 3:
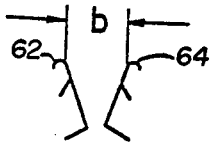
FIG. 3 shows the position of the needles when both needle beds are in the lapping position.

As shown in FIG. 3, which is the lapping position of the needles 62 and 64, the hooks acquire a much greater separation "b". This separation permits sufficient room for the underlapping displacement movement of the guide since the needles hooks have been moved out of the displacement path for an underlapping guide. This movement is achieved by utilizing a relatively short lever arms 78 and 80 for the needle bars 74 and 76, respectively, with the pivot points 82 and 84 therefor chosen below the knock-over edges 56 and 58 of the trickplates 52 and 54. Combining this arrangement with a curved shaft of the needle 66 causes the needles 62 and 64 to acquire the distance "a" in the knock-over position and the distance "b" in the lapping position.

Figure 4:
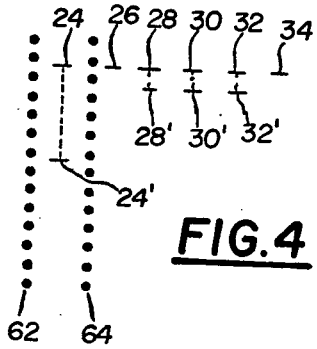
FIG. 4 is a schematic plan view of both needle beds showing the relative position of a plurality of guidebars.

Referring now to FIG. 4 which is a plan view of the needles 62 and 64 in the lapping position as shown in FIG. 3. In addition a set of guides 24, 26, 28, 30, 32 and 34 are shown in the end position of the swing movement. Guide 24 has performed an underlap movement for needles 62 and is in position 24' moving the distance of five needle separations without interference. The guides 28, 30 and 32 which form stitches on both needle rows have a small overlapped displacement so that they come into positions 28' 30' and 32'. Guide 26 which only performs an overlap with respect to needle 62 and guide 32 which only performs an underlap with respect to needle 64 are not displaced in this setting. The position of the needles and guides shown in FIG. 4 corresponds with the illustration shown in FIG. 5-III.

Figure 5:
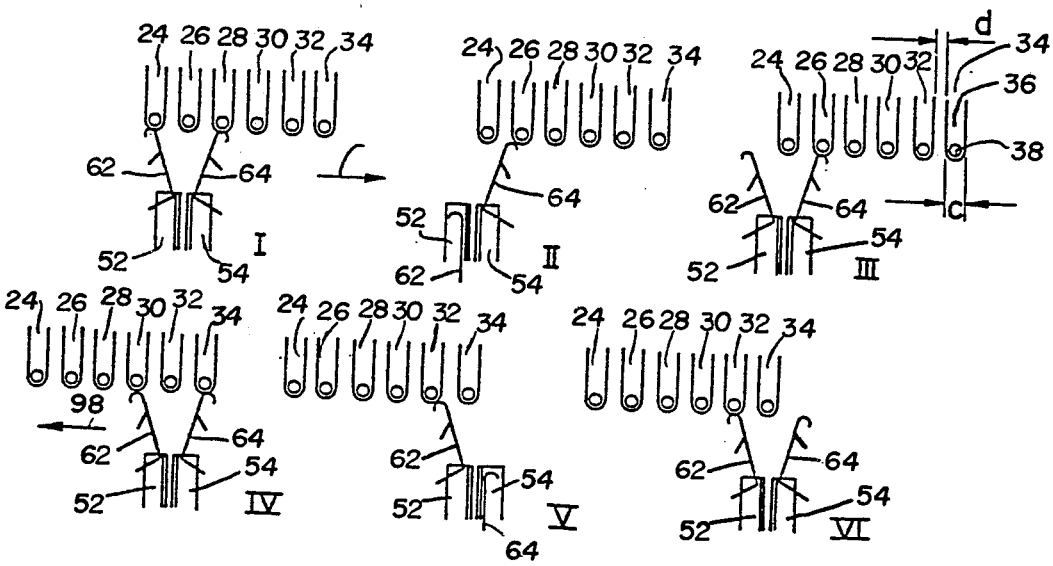
FIG. 5 shows the different positions of the needles and guides during one complete revolution of the main shaft (knitting cycle)

FIG. 5 shows in illustration I guides 24,, 26, 28, 30, 32 and 34 are moving to the right in the swing direction. A needle 62 moves downwardly into the knock-over position in illustration II and the guides have reached the rightward most position of the swing movement as shown by the arrow 96.

The position of the guides as illustrated in FIG. 4, namely the displacement movement, commences at the same time needle 62 starts to move in an upwardly direction. Because of the separation of the needle hooks 62 and 64 this does not interfere with displacement movement of the underlapping guide 24 (see III). Now all the guides move to the left in the direction of arrow 98 as shown in illustration IV and the needle 64 moves into the knock-over position, as shown in illustration V. The underlapping displacement of guide 34 and the shorter overlapping displacement of guides 28, 30 and 32 as illustrated in VI occurs next. The movement of guide 34 in the displacement direction is not interfered with by the now rising needle 64 as shown in illustration VI.

In the example illustrated, the lower end portion 36 of each guide has a width "c" preferably between 3.0 and 3.5 mm and a distance "d" between neighboring guides of approximately 0.8 to 1.0 mm. The distance "a" is about 2.5 to 5.0 mm and the distance "b" preferably is between 6.0 to 8.0 mm.

Figure 6:
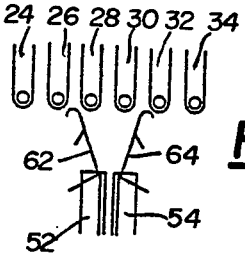
FIG. 6 shows the position of the needles and the guides when the middle guidebars perform the underlapping displacement.

FIG. 6 illustrates an embodiment of the invention wherein the two middle guides 28 and 30 perform an underlapping movement in the displacement direction wherein the needles, being in the lapping or uppermost position, provide ample room for the guides to pass therebetween. In this embodiment, where two guides must pass between the needles, the separation "a" is about 5.0 to 9.0 mm and the separation "b" is made between 9.0 and 12.0 mm.

Obviously, the number of guides can be varied in accordance with the material to be manufactured, either more or less guides may be utilized particularly, guides 26 and 28 may be omitted. In many instances, instead of utilizing guides 30 and 32 which form stitches on both rows of needles it is possible to operate with a single needle.

Rocking levers 80 and 82 preferably have a length "l" of between 100 and 200 mm, preferably 180 mm and the pivot points 82 and 84 are preferably positioned a height "h" from the knock-over edge 56 and 58 from the trick-plate 52 and 54 of between 10 to 15 mm, suitably 12 mm.

Figure 7:
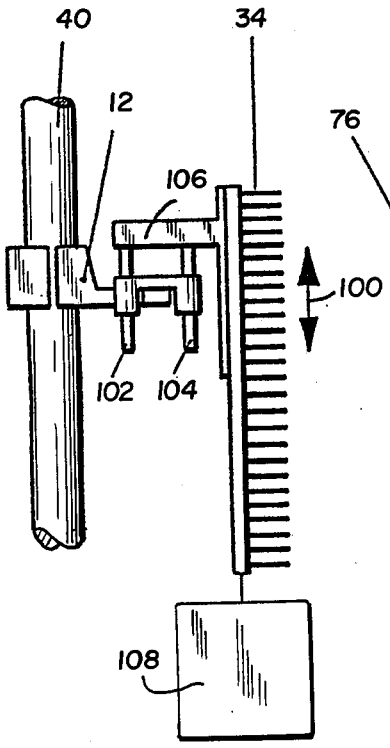
FIG. 7 shows a plan view of a guidebar suspension which enables the guidebar to be moved in the displacement direction.

The movement of the guidebar in the displacement direction is best shown in FIG. 7 wherein the guidebar 34 may be moved in a direction of arrow 100 by means of rods 102 and 104 which are adapted to be received by bearing apertures provided in the guidebar 12. The rods 102 and 104 are affixed to the housing 106 of the guides 34 thereby permitting movement in the displacement direction, in direction of arrow 100. Utilizing a conventional pattern drive i.e. chains 108 coupled to the guide housing 106, movement of the guides in the direction of arrow 100 may be obtained.

Figure 8:
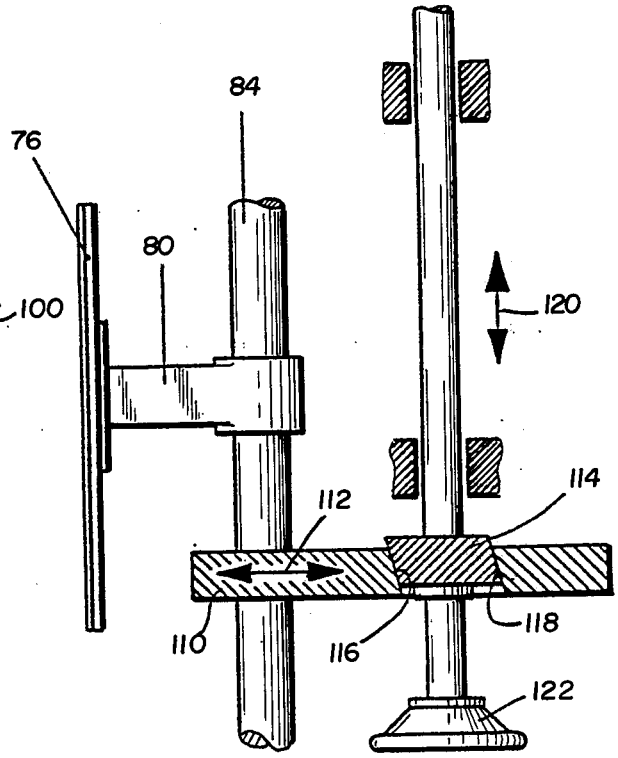
FIG. 8 is a schematic plan view of a mechanism which permits the adjustment of the spacing between the needle beds.

The adjustment of the needle bed 76 to control the distance "a" between the needle beds is accomplished by the mechanism shown in FIG. 8. The needle bar 76 is coupled by means of a lever 80 to pivot point 84 about which it may be moved. Pivot point 84 is journaled in a bearing support 110 which is movable in the direction of arrow 112 with the aid of slider block 114. Slider block 14 is provided with angled surfaces 116 and 118 which may be moved in the direction of arrow 120 by means of rotating hand wheel 122, in a conventional manner. Movement of the slider block 114 causes the inclined surfaces 116 and 118 to apply pressure to the bearing support 110 thereby moving it in the direction of arrow 112 in accordance with the sloped surfaces 116 and 118.

If it is assumed that each guide which carries out underlapping displacement has an end portion 36 of from about 3 to 3.5 mm in width then it is necessary to provide for an underlapping displacement running parallel to the needle bed a separation between the needle hooks in the order of 6 to 8 mm. Nevertheless, in the present invention, in the knock-over position the smallest separation between the needle hooks of each needle bed can be chosen to be between 2.5 mm and 5.0 mm which would normally either not permit a displacement of the underlap guides or only permit such with the greatest of difficulty. Similarly, when two adjacent guides must perform an underlap displacement and the distance between the needle hooks is required to be between 9 and 12 mm a separation in the knock-over position of only 5 to 9 mm is all that is required with the instant invention. In practice it has been possible to obtain displacements of the needle bed along the axis perpendicular to the needle bed or between 1.5 to 2.0 mm between the knock-over and lapping position of the needles.

Thus, hereinbefore has been described a twin-bed warp knitting machine having a drive for the guides arranged so that the forward and backwards swing movement of the guidebars corresponds to a single work cycle of the needle beds. The needle hooks in the knock-over position are adjustable to a separation perpendicular to the needle beds which is smaller than the width required for the underlap displacement and the needles are led on such a path that the needle hooks on their movement into the lapping position move apart from each other perpendicular to the needle bed. In moving to the lapping position from the previous knock-over position the distance from each other is at least as large as that required for the underlapping displacement movement of a guidebar. This machine operates in a single stroke drive and has a high working speed in a three-stroke machine. In the knock-over position the needle bed can be oriented so close to each other that goods that have a very short pile, for example, satin or furniture plush can be formed. Nevertheless, in the lapping position sufficient distance is provided between the needle hooks so that there is enough room to permit the underlapping guides with their threads to perform the displacement movement therebetween.

It will be understood that various changes in the details, materials, arrangements of parts and operating conditions which have been herein described and illustrated in order to explain the nature of the invention may be made by those skilled in the art within the principles and scope of the present invention.

Having thus set forth the nature of the invention, what is claimed is:

1. A twin needle bed warp knitting machine comprising:

(a) a plurality of needle bars disposed parallel to each other having a plurality of needles affixed thereon forming a pair of needle beds, said needles traversing a path from the knock-over to the lapping position which increases their separation in a direction perpendicular to said needle beds;

(b) a plurality of commonly swingable guidebars including a plurality of guides affixed thereon, said guides having flat end portions disposed parallel to the swing plane of said guides, at least one of said guidebars forming stitches on both needle beds and at least one of said guide bars performing an underlap displacement movement, said guidebars having a forward and reverse swinging movement corresponding to a single work cycle of said needle bed;

(c) means for adjusting the separation between said needles on one of said pair of needle bars from the needles on the other of said pair of needle bars when said needles are in the knock-over position, said separation being smaller than the space required for an underlap displacement by one of said guides; and (d) a pair of parallel trick plates having knock-over edges disposed between said pair of needle bars, each trick plate cooperating with one of said needle bars in the formation of stitches.

2. A twin needle bed warp knitting machine according to claim 1 wherein said separation between said needles in said lapping position is greater than the width of said guide flat end portion.

3. A twin needle bed warp knitting machine according to claim 1 wherein said needle beds move a distance of between 1.0 and 5.0 millimeters perpendicular to the needle bed between the knock-over and lapping position.

4. A twin needle bed warp knitting machine according to claim 1 wherein said needle beds are affixed to relatively short rocking lever means having a pivot point disposed below the knock-over edge of said trick plates for providing said increased separation distance between the knock-over and lapping positions of said warp knitting machine.

* * * * *